United States Patent [19]

Gris

[11] 4,220,315

[45] Sep. 2, 1980

[54] VERSATILE PULLEY

[75] Inventor: Marcel P. Gris, Cloyes-sur-le-Loir, France

[73] Assignee: Societe Anonyme Dite: Establissements Catu S.A., Bagneux, France

[21] Appl. No.: 817,605

[22] Filed: Jul. 21, 1977

[30] Foreign Application Priority Data

Jul. 29, 1976 [FR] France ..... 76 23143

[51] Int. Cl.[2] ..... A62B 1/14

[52] U.S. Cl. ..... 254/236; 254/270

[58] Field of Search ..... 254/155, 156, 154, 193, 254/175.3, 192

[56] References Cited

U.S. PATENT DOCUMENTS

| | | | |
|---|---|---|---|
| 118,172 | 8/1871 | Wethered | 254/155 |
| 866,516 | 9/1907 | Purdy | 254/156 |
| 2,649,282 | 8/1953 | Fate, Jr. | 254/193 |
| 3,307,832 | 3/1967 | Van Zelm et al. | 254/156 |

FOREIGN PATENT DOCUMENTS

| | | | |
|---|---|---|---|
| 2439678 | 4/1976 | Fed. Rep. of Germany | 254/156 |
| 186281 | 9/1922 | United Kingdom | 254/156 |

*Primary Examiner*—Kenneth W. Noland

*Attorney, Agent, or Firm*—Fulwider, Patton, Rieber, Lee & Utecht

[57] ABSTRACT

The present invention relates to an ordinary pulley whose pintle is borne by a shell provided with a device for suspension from a fixed point and which is adapted to receive a handling or hauling rope, said shell further comprising an auxiliary braking system independent of the pulley, in which said rope is engaged only when the device is to be used as a rescue device for lowering persons, particularly injured or unconscious persons.

1 Claim, 5 Drawing Figures

VERSATILE PULLEY

The present invention relates to the field of handling instruments and to life-saving (rescue) apparatus, and concerns more particularly the personnel carrying out work on aerial power line supports.

For carrying out work of any nature in elevated position above ground level, pulleys are usually used which are suspended from a fixed point, over which is passed a rope serving to lift or lower various loads from one level to the other.

Such devices are described in particular in Australian Pat. No. 407,416 and French Pat. No. 692,999, and these devices further comprise members for blocking the rope. However, it should be noted that, to release the rope, it is necessary to modify its orientation, in order to disengage the blocking member.

On the other hand, and particularly in the case of works on power line supports, rescue devices are used which enable the body of an injured or unconscious person, in particular further to electrocution, to be lowered to the ground.

Such devices are described in particular in British Pat. No. 20894/1909. German Pat. No. 933,333, French Pat. Nos. 545 163 and 995 304.

The main drawback of these devices is the time necessary to prepare them for use: a rescue device is almost never available on the support where the accident occurs and time is spent looking for it, climbing the support, unwinding the rope and fastening it, etc . . . , in circumstances where the time factor is of prime importance.

On the other hand, to be able to exert a braking action, the rescuer must necessarily be below the injured person, which, if he must act alone, considerably increases the difficulty of the operation.

The work team often does not have available any equipment suitable for lowering an injured person, whereas there is almost always an ordinary pulley on the spot.

With a view to allowing quicker and easier action, the present invention relates to an ordinary pulley incorporating a braking system similar to that of a rescue device and which makes it possible, in the case of an accident, to use the pulley and rope to the exclusion of any special equipment, to lower the injured person in the minimum of time; to this end, it suffices, as will be seen more fully hereinbelow, to make a simple, rapid manoeuvre to engage the rope in the braking system and to loop it around the victim's body.

In addition, the pulley according to the invention enables the descent to be controlled and braked by an operator located at any level between the ground and the pulley.

The invention also makes a considerable saving, in that the cost of the pulley described hereinafter is much lower than the total cost of an ordinary pulley and a rescue device, and the use of a special rescue rope is no longer necessary.

The invention will be more readily understood on reading the following description with reference to the accompanying drawings, in which.

Figure 1:
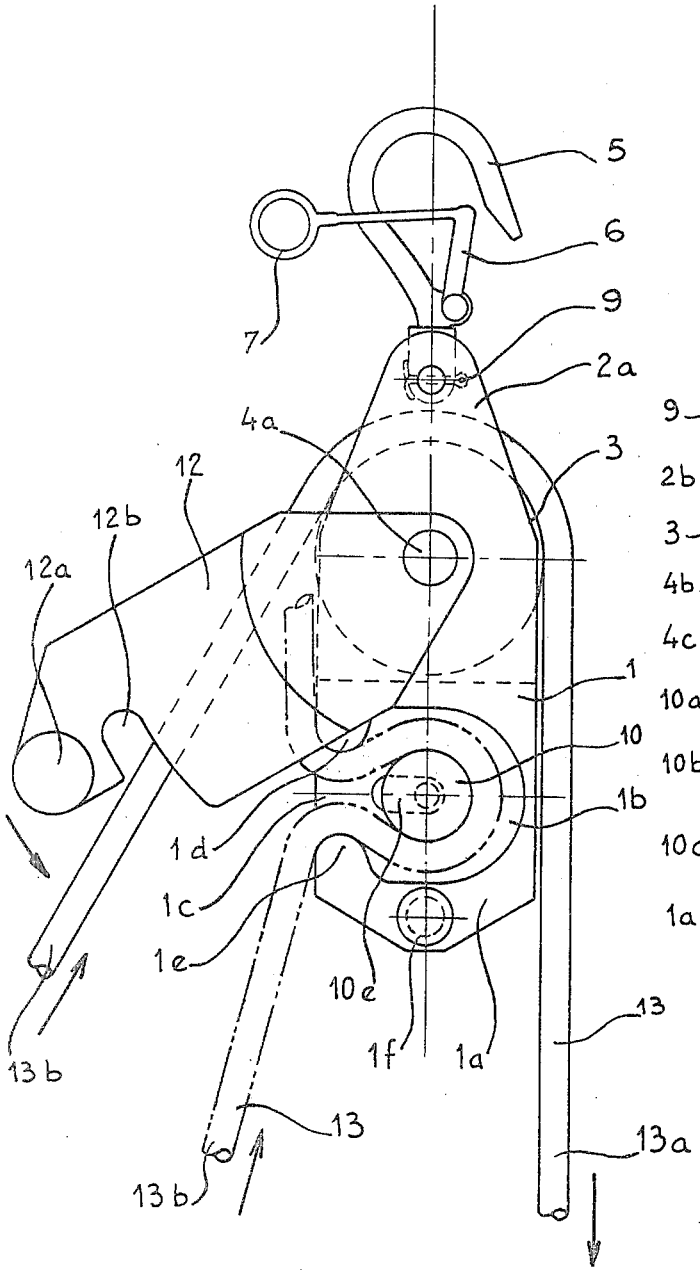
FIG. 1 shows a view in elevation of an ordinary pulley incorporating a braking system according to the invention showing a rope both in normal hauling position and in rescue position.
Figure 2:
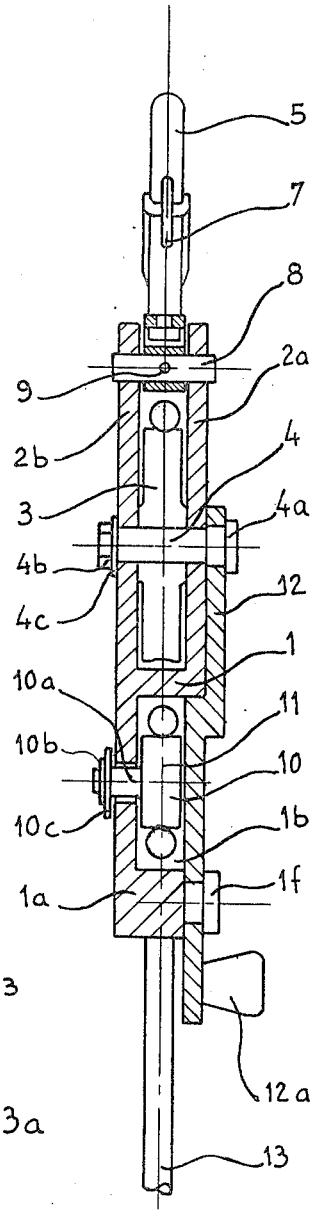
FIG. 2 shows a side view in section of the same embodiment.

Referring now to the drawings, FIGS. 1 and 2 show a preferred embodiment of the invention given by way of example, wherein the pulley comprises a shell 1 made of metal or, preferably, of insulating material, said shell comprising two cheeks 2*a* and 2*b* between which is housed a sheave 3 adapted to rotate freely on a pintle 4 passing through cheeks 2*a* and 2*b* and held in position by means such as an enlarged head 4*a* on one side and a nut 4*b* and washer 4*c* on the other.

The top of the pulley is provided with a suspension hook 5 provided with a safety catch 6 which may possibly be provided with a ringed control rod 7 enabling the device to be placed in position with the aid of the hooked poles used for works on electric power lines. The bottom of said hook 5 has a spindle 8 passing therethrough as well as through the cheeks 2*a* and 2*b*, a means such as a cotter pin 9 mechanically connecting said hook to the spindle 8 and preventing said spindle from escaping laterally.

The lower part of the shell 1 is extended by a body 1*a*, in one of the faces of which a cavity 1*b* is made, which houses a roller 10 whose axis of symmetry 11 shown in broken lines coincides with that of the sheave 3. The roller 10 extends through the bottom of the cavity by a spindle 10*a* laterally immobilised by means such as an elastic brake 10*b* and a washer 10*c*. Said spindle 10*a* passes through the bottom of the cavity 1*b* through a slot 10*e* of oblong shape enabling it to move transversely. On the other hand, the cavity 1*b* presents on one side a lateral opening 1*c* narrower than the central part of said cavity and the entrance of which is defined by two bosses 1*d* and 1*e*. The opening of the cavity 1*b* in the body 1*a* may be closed by a mobile flap 12 whose shape is substantially the same as the outer contour of body 1*a*. This flap 12 may pivot about axis 4 of the sheave 3, it is provided with a manoeuvring knob 12*a* and with means for maintaining it is closed position, for example a notch 12*b* cooperating with a stud 1*f*.

FIG. 1 shows a rope 13 engaged in the pulley, the weight bearing portion of which, 13*a*, carries the load, the lifting or restraining portion 13*b*, being the free, or retaining weight bearing portion which the user pulls to raise or lower a load suspended on end 13*a*. The same rope 13 has also been shown, in broken lines, in the position when the pulley is used as rescue device. In this position, said rope 13 passes, as in the first case, around the sheave 3 but is further engaged on roller 10 around which it describes a loop whose contour is more than 180°, the ends of said loop passing through opening 1*c* and rubbing against bosses 1*d* and 1*e*.

To place the rope 13 in this position, the user firstly opens flap 12 with the aid of the knob 12*a* into the position shown in FIG. 1, thereby disengaging the opening of cavity 1*b*, he engages the lifting or restraining portion 13*b* of the rope 13 around roller 10, as has just been stated, then closes the flap 12 by engaging the lug 1*f* in the notch 12*b*.

In this position, assuming that the body of an injured person has been suspended from weight bearing portion 13*a* and the user is exerting a sufficient pull on the lifting or restraining portion 13*b*, the roller 10 will tend to move towards the opening 1*c* due to the play of the slot 10*e* and to jam the rope against bosses 1*e* and 1*d* with a sufficient force to immobilise said rope 13. If the user then slackens the pulling force on the end 13*b*, the rope 13 will begin to slide on bosses 1*e* and 1*d* and the user may control the speed of descent of the victim as desired, by exerting a moderate retaining force on the lifting or restraining portion 13*b*.

Figure 3:
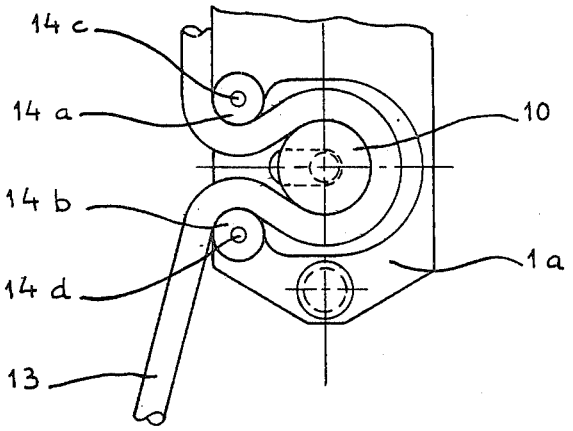
FIG. 3 shows a part view in elevation of another embodiment of the brake of the rescue device.

In a variant embodiment shown in FIG. 3, and with a view to limiting the wear and tear of the cord 13 by the effect of its friction against bosses 1*d*, 1*e*, said latter may be replaced by two rollers 14*a*, 14*b* of small diameter, rotating freely about their respective spindles 14*c*, 14*d*.

Figure 4:
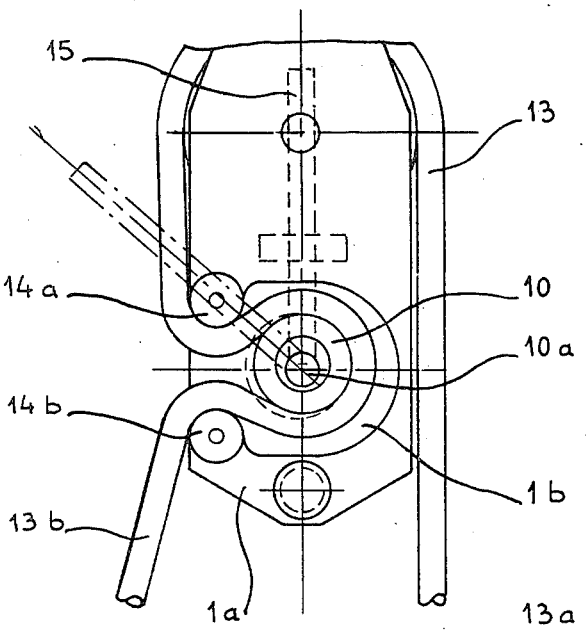
FIG. 4 shows a part view in elevation of a third embodiment of the brake of the rescue device.
Figure 5:
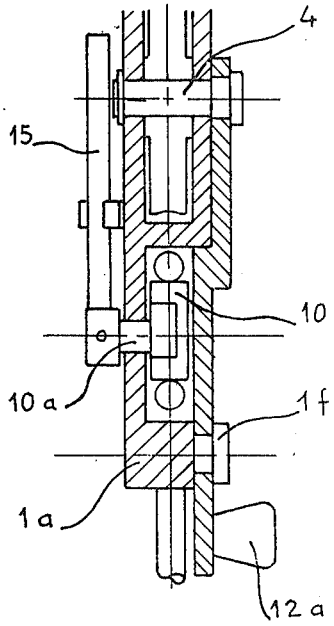
FIG. 5 shows a part view in section of the side of the same embodiment.

In another variant, shown in FIGS. 4 and 5, the spindle 10*a* of roller 10 is eccentric with respect to said latter and is provided with a control lever 15. In this embodiment, the slot 10*e* is replaced by a cylindrical hole whose diameter corresponds to the spindle 10*a* and which is made substantially at the centre of cavity 1*b*.

In this embodiment, the braking of the rope 13 against the rollers 14*a*, 14*b* or possibly bosses 1*d*, 1*e*, is no longer controlled by a pull exerted on the lifting or restraining portion 13*b*, but by manoeuvring the lever 15. According to the position of said lever and due to the eccentricity of the roller 10 with respect to its spindle 10*a*, the operator may obtain either a blocking or controlled braking of the rope 13.

It should be noted that the weight bearing portion 13*a* is normally considered as being the loaded, the lifting or restraining portion and end 13*b* as the retaining end, but, if, in the haste in dealing with an accident, the body of the victim is suspended by error on the lifting or restraining portion 13*b*, and the retaining force is then exerted on the weight bearing portion 13*a*, there would be no serious consequence as the braking is also effective in this direction.

It is obvious that other forms and arrangements may be imagined of the elements for exerting on the rope a braking of variable force depending on the pull exerted on the retaining end, and that such variants would not depart from the scope of the invention.

What is claimed is:

1. In a rescue device for lowering persons, an ordinary pulley whose pintle is disposed about a horizontal axis and is borne by a rigid shell provided at its upper part with means for overhead suspension from a fixed point, closed on its two faces and opened on both its ends and which is adapted to receive a handling or hauling rope, said shell further comprises a braking system independent of and located below the pulley and wherein one of said faces of said shell comprises a flap rotatably mounted adjacent said pintle and coaxial therewith and rotatable to expose the braking system, and wherein the braking system is housed in an extension of the lower part of the shell, and is constituted by a C-shaped cavity and containing a mobile roller in horizontally reciprocal coplanar relationship with said pulley and around which the rope may be placed forming a loop so that said roller is moved towards the opening of the cavity jamming the said rope in the said opening with a force which is dependent upon the pulling force of the rope.

* * * * *